US008820559B2

(12) United States Patent
Beitler et al.

(10) Patent No.: US 8,820,559 B2
(45) Date of Patent: Sep. 2, 2014

(54) SHIPPING CONTAINERS FOR FLOWABLE MATERIALS

(75) Inventors: Stephen S. Beitler, Highland Park, IL (US); Rebecca A. Ayers, Chicago, IL (US); Christian B. Beaudoin, Evanston, IL (US); Ryan Joseph Johnson, San Francisco, CA (US)

(73) Assignee: Lake Effect Advisors, Inc., Highland Park, IL (US)

( * ) Notice: Subject to any disclaimer, the term of this patent is extended or adjusted under 35 U.S.C. 154(b) by 0 days.

(21) Appl. No.: 13/205,054

(22) Filed: Aug. 8, 2011
(Under 37 CFR 1.47)

(65) Prior Publication Data

US 2012/0085756 A1 Apr. 12, 2012

Related U.S. Application Data

(60) Provisional application No. 61/372,348, filed on Aug. 10, 2010.

(51) Int. Cl.
*B65D 88/00* (2006.01)

(52) U.S. Cl.
USPC ..... 220/1.5; 220/563; 206/819; 206/512

(58) Field of Classification Search
USPC ..... 220/1.5, 668, 645, 563, 4.12, 565; 206/512, 819, DIG. 11
See application file for complete search history.

(56) References Cited

U.S. PATENT DOCUMENTS 2,446,811 A 8/1948 Crawford
3,543,951 A * 12/1970 Marvin ..... 206/503
3,661,293 A 5/1972 Gerhard
3,776,169 A * 12/1973 Strecker ..... 220/23.6
3,799,383 A 3/1974 Gerhard
3,834,575 A * 9/1974 Carr ..... 220/1.5
3,912,103 A 10/1975 Gerhard
3,932,946 A * 1/1976 Johnson ..... 34/201

(Continued)

FOREIGN PATENT DOCUMENTS

WO W02010/009061 A1 1/2010

OTHER PUBLICATIONS

Patent Cooperation Treaty, Notification of the International Search Report and the Written Opinion of the International Searching Authority, or the Declaration, in International Application No. PCT/US11/46930, dated Jan. 26, 2012. (15 pages).

(Continued)

*Primary Examiner* — Andrew Perreault
(74) *Attorney, Agent, or Firm* — McAndrews, Held & Malloy, Ltd.

(57) ABSTRACT

A container for shipping and storing flowable materials includes generally planar walls that form or enclose a generally-box shaped vessel for holding flowable material. The container includes a plurality of corner fittings and optionally a plurality of connecting members that provide a frame structure to support the corner fittings. The corner fittings enable the container to be lifted and to be secured to a transport platform, transport vehicle, and/or another container. The vessel walls may be composed of a material that is not as strong or as dense as the material that forms the corner fittings and/or connecting members. The vessel walls may be corrugated and/or include a support structure overlaid on their exterior surface to increase the strength of the walls. The vessel interior may contain baffles to reduce sloshing and increase the strength of the vessel walls.

17 Claims, 14 Drawing Sheets

(56) References Cited

U.S. PATENT DOCUMENTS

| | | | | | |
|---|---|---|---|---|---|
| 4,345,698 | A | | 8/1982 | Villemain | |
| 4,476,988 | A | * | 10/1984 | Tanner | 220/1.5 |
| 4,746,034 | A | * | 5/1988 | Ata et al. | 220/1.5 |
| 4,911,317 | A | * | 3/1990 | Schloesser et al. | 220/1.5 |
| 4,912,194 | A | | 3/1990 | Rosenquist | |
| 5,050,765 | A | | 9/1991 | Roser | |
| 5,378,539 | A | | 1/1995 | Chen | |
| 5,671,855 | A | * | 9/1997 | Norman et al. | 220/1.5 |
| 5,761,854 | A | * | 6/1998 | Johnson et al. | 52/69 |
| 5,960,974 | A | | 10/1999 | Kee | |
| 5,979,684 | A | * | 11/1999 | Ohnishi et al. | 220/1.5 |
| 6,220,472 | B1 | * | 4/2001 | Townsend et al. | 220/563 |
| 6,382,457 | B1 | * | 5/2002 | Bernard et al. | 220/651 |
| 6,401,983 | B1 | | 6/2002 | McDonald | |
| 6,564,961 | B1 | * | 5/2003 | Klein | 220/563 |
| 6,589,620 | B1 | * | 7/2003 | Abu-Isa | 428/36.6 |
| 6,811,048 | B2 | * | 11/2004 | Lau | 220/1.5 |
| 7,032,771 | B2 | | 4/2006 | Pfau | |
| 7,169,452 | B1 | | 1/2007 | Monk et al. | |
| 7,252,309 | B2 | | 8/2007 | Goh | |
| 7,252,468 | B2 | | 8/2007 | Moore | |
| 7,334,697 | B2 | * | 2/2008 | Myers et al. | 220/1.5 |
| 7,717,290 | B2 | * | 5/2010 | Gerding | 220/1.5 |
| 7,897,223 | B2 | | 3/2011 | Schubbach | |
| 2004/0071912 | A1 | | 4/2004 | Berth | |
| 2004/0211783 | A1 | | 10/2004 | Hunt | |
| 2008/0190918 | A1 | | 8/2008 | Bellmore | |
| 2008/0220259 | A1 | | 9/2008 | Monk | |
| 2009/0071955 | A1 | | 3/2009 | Firth | |
| 2009/0134171 | A1 | | 5/2009 | deBerardinis | |
| 2009/0134999 | A1 | | 5/2009 | Dobson | |
| 2009/0277900 | A1 | | 11/2009 | Howison | |

OTHER PUBLICATIONS

Palletizzed Load System (PLS), PLS Modular Fuel Farm, Advancing Truck Technology, Oshkosh Truck Corporation (2 pages), on or before 1999.

WEW, First UK MoD Tank Containers from WEW, http://www.army-technology.com/contractors/logistics/wew/press1.html, Jun. 5, 2008 (2 pages).

WEW, Military Tank Containers, http://www.army-technology.com/contractors/logistics/wew/wew1.html (2 pages), Mar. 31, 2010.

WEW, Military Tank Containers, http://www.army-technology.com/contractors/logistics/wew/wew2.html (1 page), Mar. 31, 2010.

WEW, Military Tank Containers, http://www.army-technology.com/contractors/logistics/wew/wew3.html (1 page), Mar. 31, 2010.

Haas, Captain Peter M., Palletized Loading System: Not Just Another Truck, Army Logistician, Sep.-Oct. 1996, http://www.almac.army.mil/alog/issues/sepoct/ms100.htm (4 pages).

Swap Body, Uniteam AS, Norway, http://uniteamcontainer.com/container/logistic-concepts/swap-body.html (1 page), 2008.

Heater, Dr. Kenneth J., Self-Sealing Fuel Tank for the EFV, METSS Corporation, Westerville, OH (5 pages), 2004.

Multi-Purpose Fire Fighting Power, HEMTT-Based Water Tender (Hewatt), Pierce Manufacturing, Inc., an Oshkosh Truck Corporation Company, Appleton, WI (2 pages), Oct. 2007.

850 Gallon Vertical Liquid Storage Tank, www.gototanks.com/VT0850-54.aspx (2 pages), Apr. 4, 2010.

Loading and Securing Sixcons (U.S.M.C. Only), Integrated Publishing, http://www.tpub.com/content/operatormanuals/TM-9-2330-381-14/TM-9-2330-381-140279.htm (3 pages), Nov. 1994.

TSS—Explosion-Proof and Self-Sealing Fuel Tanks, TSS International BV, Netherlands, http://www.army-technology.com/contractors/protection/tss (2 pages), May 7, 2010.

Cartage Tanks, Rapid Plus One System, Daisy T:/Brochures/RapidSpray/Cat05Feb07/pg4-5_Modular_CartageTanks_2pg_np (2 pages), Feb. 2007.

PCT, Notification Concerning Transmittal of International Preliminary Report on Patentability, in Application No. PCT/US11/046930, dated Mar. 6, 2014. (12 pages).

* cited by examiner

SHIPPING CONTAINERS FOR FLOWABLE MATERIALS

RELATED APPLICATIONS

This application claims priority from Ser. No. 61/372,348, filed Aug. 10, 2010, which is hereby incorporated by reference.

FEDERALLY SPONSORED RESEARCH OR DEVELOPMENT

[Not Applicable]

MICROFICHE/COPYRIGHT REFERENCE

[Not Applicable]

BACKGROUND OF THE INVENTION

Containers can be used to transport and/or store flowable materials. Flowable materials may include liquids such as water, fuel, or other chemicals, and may also include any other material capable of flowing such as sand, grain, slurry, etc. Several significant challenges that are not present with bulk dry goods arise when transporting flowable materials. These include, among others, the higher weight-to-volume ratio of flowable material compared to that of bulk dry goods, the flowable nature of flowable materials, which requires an impermeable containment vessel of adequate strength, the extreme flammability of some flowable materials such as gasoline and other fuels and chemicals, and the lack of vertical and horizontal linking and hoisting components in flowable materials vessels (or tanks).

In many cases, the payload (weight) limits of a transport apparatus (e.g., ship, truck, trailer, aircraft (fixed and rotary wing), rail car, parachute drop, and low altitude parachute extraction systems (LAPES)) constrain the amount of flowable material that can be transported. In contrast to dry goods containers, which typically exceed volume limits before they exceed weight limits, flowable material containers often achieve the maximal weight before they reach the maximal volume. In order to increase the quantity of flowable material transported without increasing the payload limit of the transport apparatus, the tare weight of the container must be decreased.

Steel and aluminum containers characterized by a vessel having a round cylindrical shape are known in the art and can be used to transport and/or store fuel. While these types of containers may be fire and heat resistant and prevent significant permeation of fuel vapors, the heavy weight of the steel or aluminum constrains the amount of fuel that can be transported. Furthermore, use of a round cylindrical vessel (due to its non-orthogonal morphology) does not allow for efficient integration of the vessel between different components of the transport infrastructure used in inter-modal transport, such as ships, trucks, trailers, aircraft, and rail cars, whose cavities are typically orthogonal. In other words, significant amounts of space are wasted between the cylindrical vessel and the smallest box-shaped space (right cuboid envelope) within which the cylindrical vessel could fit. Additional problems with containers having round cylindrical vessels include the inability to stack them and the lack of corner fittings to secure them within the cavities of ships, trucks, trailers, aircraft, rail cars, etc.

Additionally, lack of corner fittings for hoisting cylindrical vessel containers limits their use in any settings where lifting, loading, unloading, or otherwise moving by cranes, spreaders, and aircraft can be required, as is typically the case for moving larger containers that meet International Organization for Standardization (ISO) standard 668:1995 (i.e., ISO containers). In military settings, in addition to the above methods of hoisting, sling loads may be used, which become more cumbersome with containers lacking corner fittings. Employing a box-shaped (right cuboid) steel cage or frame surrounding a cylindrical steel vessel and equipping it with corner fittings to allow linking and stacking of cylindrical vessel containers is known. However, the steel cage or frame increases the container's total tare weight and, thus, diminishes the quantity of the asset (e.g., gasoline or other flowable material) that can be transported. Therefore, while steel cages or frames promote transportability, they further limit the capacity of a cylindrical vessel container (assuming the payload weight limit of the transport apparatus remains the same).

Polyethylene containers are known in the art and can reduce the weight of a container below that of a steel container. However, existing polyethylene containers have several drawbacks. They are not compatible with certain ISO standards and therefore are not compatible with certain aspects of existing ISO transport infrastructure, vehicles and platforms. They typically do not have corner fittings to allow hoisting and securing. They are cylindrical, like their steel counterparts, and thus not made to be stacked efficiently.

In the military, there is a significant burden of transporting liquids, especially fuel and water. A Nov. 10, 2009 article in the *Wall Street Journal* titled "Fuel Fighter: The U.S. Military Is a Gasoline Glutton" identified fuel supply lines as being costly and dangerous. The article cites a study by consulting firm Deloitte which "suggests that the Army reduce the need for fuel convoys." According to "Battlefield Renewable Energy" by Adams et al in the *Joint Force Quarterly* (issue 57, 2010), "through analysis, MNF-W [Multi-National Force-West in Iraq] determined that most casualties occurred during the movement and delivery of fuel to the various combat outposts and bases throughout the division's area of operations."

An improvement in fuel efficiency by vehicles, generators and other equipment, vehicles, or infrastructure requiring fuel, is often recommended as a means for reducing fuel convoys, and, hence, the burden of transporting fuel. However, to reduce the number of fuel convoys, increasing the volume of fuel transported per transport apparatus (e.g., per truck or trailer) will have significantly greater effect on lessening the burden of transporting fuel than improving the military's overall fuel efficiency. Specifically, studies by the inventors of the utilization certain embodiments of the present invention within the US military show that increasing the volume of fuel transported per transport apparatus will decrease the economic costs by 18% to 40% while improving the military's overall fuel efficiency is only expected to result in 3% economic cost savings. Increasing the volume of fuel that can be transported per transport apparatus has been overlooked, perhaps due to difficulties in calculating the Fully Burdened Cost of Fuel (FBCF), i.e., the cost for fuel transport in addition to the fuel commodity itself, which provides a metric that can be used in assessing the casualties that could be prevented and the monetary savings that could be achieved as a result of using an alternate transportation system for transporting fuel. According to the Defense Science Board, as stated in an article in the April 2010 issue of *National Defense*, the Pentagon has not yet established "reliable methods for measuring the 'fully burdened' cost of fuel." An analogous, but different, calculation is the Fully Burdened Cost of Water (FBCW), i.e., the cost for water transport in addition to the water itself, which provides a metric that can be used in assessing the casualties that could be prevented by and the monetary savings of using an alternative transportation system for water.

In the military, there is a need for flexibility and efficiency, and for accommodation of quickly changing plans. Large containers transport more material or liquid per load with less loading and unloading of containers. However, smaller containers allow for more flexibility with smaller amounts of material being collected or delivered to different locations. There is a need for a modular system of containers to enable the delivery of a range of load sizes (small to large, including intermediate loads), whereby small containers are linked together to create increasingly larger increments of load. There is also a need for a modular system of containers to enable the delivery of a range of load sizes (small to large, including intermediate loads), whereby smaller load sizes of flowable materials can be delivered quickly by disengaging modular containers from one another as opposed to transferring (e.g., pumping) flowable material from a larger container to a smaller container, a process that can introduce contamination in addition to expending time. Further, there is a need for a modular system of containers to enable the delivery of a diversity of materials whereby containers, which may be built from different types of materials that can transport and store a range of liquid and dry assets, are linked together to create mixed loads. Such a modular system achieves the benefits of easily transporting larger volumes when large volume transport is required, smaller volumes when small volume transport is required, and homo- and heterogeneous loads, and is compatible with a hub and spoke model of transport where large and then progressively smaller loads are delivered to hubs of diminishing sizes (in terms of the volume of load delivery requested).

Therefore, there is a need for an improved container being able to transport a greater quantity of flowable material per load than prior containers of the same orthogonal envelope, being integrated with existing transportation infrastructure, vehicle and equipment requirements, having similar fire and heat resistant properties that are observed for steel and aluminum containers, being self-sealing upon puncture or cracking to prevent the loss of flowable material and to avoid injury, and being modular so as to accommodate the dynamic requirements of load size and type of modern civilian and military logistics operations for flowable material.

BRIEF SUMMARY OF THE INVENTION

Certain embodiments of the present invention provide modular and intermodal containers for shipping and storing flowable materials. A container may have generally planar walls that are generally orthogonal to one another and may form or contain a generally box-shaped vessel therebetween for flowable material. The walls may be made of a lightweight but strong material to minimize the tare weight of the container. The walls may be reinforced via internal baffles that help hold them together, via corrugation folds in the walls, and/or via a support structure overlaid on the external surface of the walls. The container may include corner fittings for hoisting of the container, securing the container to a transportation platform, vehicle or equipment, and stacking and linking of the container with other containers. Containers may be modular, meaning that multiple containers may be secured together to be transported as a single unit and then disassembled rapidly as needed. If the lightweight material of the container is not strong enough to bear the weight of another container stacked on top, the container may be supplemented with connecting members such as rods or beams made of steel or other strong material that interlock and support the corner fittings with respect to one another. The container may be self-sealing and fire-resistant. The container may also include legs for use in autonomously loading and unloading the container from a truck or trailer in the absence of any additional equipment. The container may also include storage spaces for non-flowable materials or equipment such as pumps, hoses, fire extinguishers, generators, solar panels, and other necessary or optional equipment. The container may have one or more rollers on the bottom to allow the container to be rolled with respect to a surface such as the ground or a surface of a transport apparatus or platform. The container may be compatible with existing international standards in the transport industry such as those that are set by the International Organization for Standardization (ISO) and the American National Standards Institute (ANSI). The container may be intermodal meaning that it may be seamlessly transferred among and transported by different modes such as by ship, truck, trailer, aircraft, rail car, or any other transport vehicle or platform. The container may also be equipped with sensors and appropriate electronic equipment to facilitate container informatics and optimize logistics.

Figure 1:
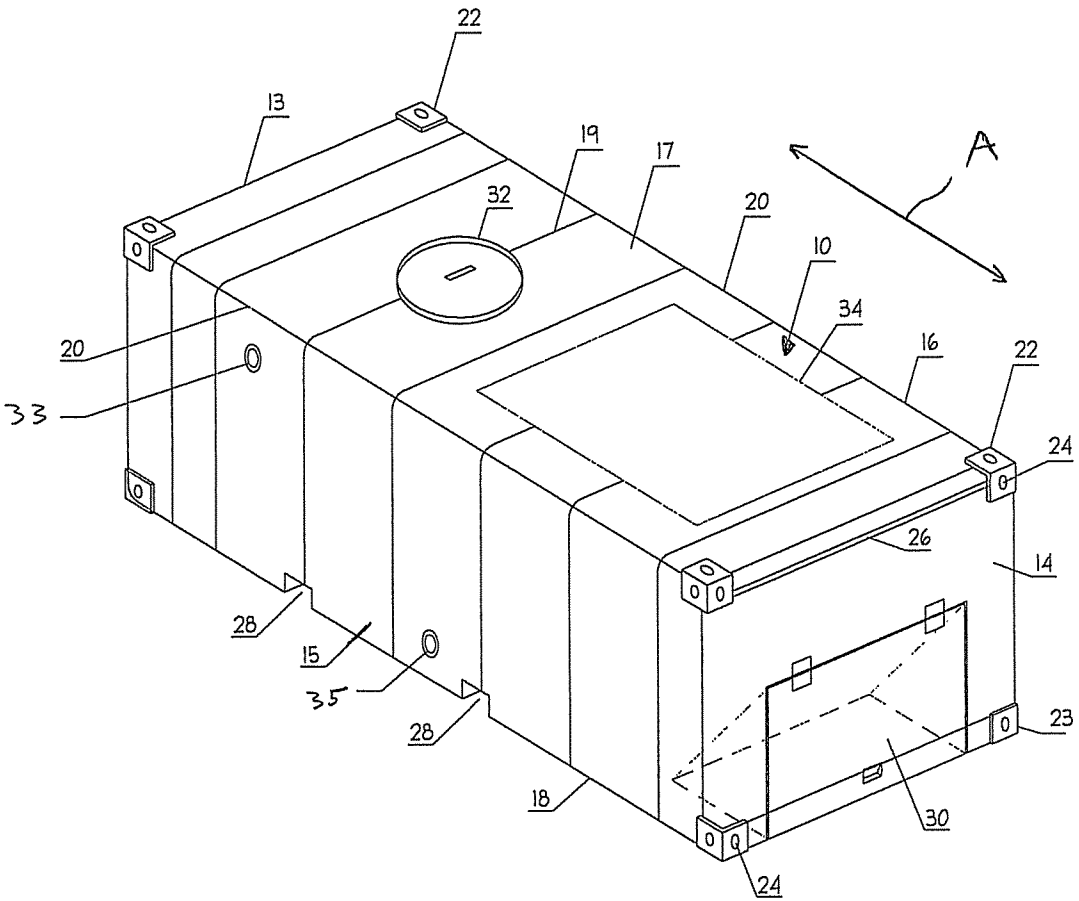
FIG. 1 illustrates an isometric view of a container according to an embodiment of the present invention.

The foregoing summary, as well as the following detailed description of certain embodiments of the present invention, will be better understood when read in conjunction with the appended drawings. For the purpose of illustrating the invention, there is shown in the drawings certain embodiments. It should be understood, however, that the present invention is not limited to the arrangements and instrumentalities shown in the attached drawings.

DETAILED DESCRIPTION OF THE INVENTION

FIG. 1 illustrates a lightweight, intermodal and modular container 10 for shipping flowable materials that is compatible with existing military and civilian transportation infrastructure, equipment, vehicles, and regulations. Flowable materials may include liquids such as water, fuel, or other chemicals, and may also include any other material capable of flowing such as sand, grain, slurry, etc. Certain embodiments of the present invention may employ containers for flowable materials generally, containers for liquid flowable material, containers for non-liquid flowable material, and containers for specific liquids such as water or fuel, including gasoline, ethanol, diesel, kerosene, or jet propellant (e.g., JP-8).

The container 10 is formed by planar front and rear end walls 13 and 14, generally planar left and right side walls 15 and 16, and generally planar top and bottom walls 17 and 18. (A longitudinal direction from rear to front is provided by arrow A.) Each of the walls 13-18 is arranged perpendicularly to the four other walls it abuts resulting in a generally box-shaped container 10. The walls 13-18 are composed of fiberglass.

As mentioned above, the side, top, and bottom walls 15-18 are only generally planar. They are not perfectly planar due to corrugation folds 19 that are employed to improve the strength of the side, top, and bottom walls 15-18. They are also not perfectly planar due to their longitudinally-extending edges 20 being somewhat rounded where they abut other walls, which rounded edges 20 are also employed for strength purposes. For example, left side wall 15 and top wall 17 are both rounded along the edge 20 where they meet one another. In contrast to the side, top, and bottom walls 15-18, the end walls 13 and 14 are fully planar. Depending on the strength needs, corrugation folds 19 and/or rounded edges 20 may be used more or less extensively (or not at all) in other embodiments of the present invention.

It should be noted that each of the walls 13-18 is at least generally planar so that the container 10 is at least generally box-shaped. This allows for the container 10 to be stackable and securable with respect to other containers without wasting much, if any, space. This also allows for the vessel (described below) of the container 10 to be of the maximum or close to the maximum of allowable volume for the given box-shaped space (right cuboid envelope) that is formed by the walls 13-18.

The container 10 includes a corner fitting at each of its eight corners, four upper corner fittings 22 and four lower corner fittings 23. Each corner fitting 22 and 23 has three eyelets 24 for receiving twist locks (not shown) that are commonly used in the shipping industry. The corner fittings 22 and 23 allow the container 10 to be hoisted, for example, when being loaded to or unloaded from a transport apparatus such as a ship, truck, trailer, aircraft (fixed or rotatary wing), or rail car. The corner fittings 22 and 23 also allow the container 10 to be secured to other containers stacked above, below, or next to the container 10 or to a transportation platform. Because the container 10 is a right cuboid or box-shaped, a group of such containers may be efficiently stacked on top of and next to one another as is commonly done with ISO containers for non-flowable materials in the shipping industry. The hoisting, handling, and securing of the container 10 may conform to ISO standard 3874:1997. The corner fittings 22 and 23 also allow a group of containers 10 to be secured to one another and hoisted as a single unit. The corner fittings may conform to ISO standard 1161:1984.

It is typical for corner fittings to be made of steel, and the corner fittings 22 and 23 of the container 10 may likewise be composed of steel. Certain embodiments of the present invention, however, may also employ corner fittings that are substantially composed of another metal or of a non-metal material. (As used herein, metal refers to single metals such as titanium as well as metal alloys such as steel.) Additionally, a corner fitting that is substantially composed of a non-metal material may nevertheless include eyelets that are lined with a material that—unlike the rest of the corner fitting—is substantially composed of metal.

The container 10 also includes a lift bar 26 for maneuvering the container 10 as it is rolled, for example, off of the back of a truck or trailer. (The rollers 41 are described below with respect to FIGS. 4 and 5.) The lift bar 26 is shown in FIG. 1 near where rear end wall 14 and top wall 17 meet. However, in other embodiments it may be advantageous to have a lift bar in alternative locations and/or orientations. In still other embodiments, multiple lift bars may be employed to create versatility with respect to acceptable orientations of a container with respect to a truck or trailer from which it is to be rolled off.

In addition to the aforementioned methods of lifting, loading, unloading, and otherwise moving with cranes, spreaders, slingloads, etc, the container 10 can also be handled with a forklift. In that regard, the bottom wall 18 includes two parallel channels 28 extending transversely therethrough for receiving the tines of a forklift. The forklift channels can also extend longitudinally (90 degrees rotated to what is shown in the figure).

The container 10 includes two small compartments 30 (only one can be seen in FIG. 1). The compartments 30 are optional and the size may depend on the needs of the supplier, shipper, or end user. For example, the compartments 30 may house non-flowable material or equipment, such as a pump, hose, fire extinguisher, generator, solar panel and/or a battery. Other than the two compartments 30, the entire inside of the container 10 functions as a vessel 42 (vessel 42 shown in FIGS. 5 and 6) for holding and containing the flowable material. As such, the vessel 42 has a transverse (e.g., as taken from side to side) cross-section that is generally rectangular through most of the length of the container 10. One or both of the compartments 30 may be reduced in volume or eliminated to increase the volume of the vessel 42 and reduce the tare weight of the container and, therefore, increase the capacity of flowable material that can be shipped with the container 10. The vessel 42 is box-shaped but for the spaces occupied by the compartments 30, the corner fittings 22 and 23, and other possible apparatuses that are described below. As can be readily ascertained, elimination of the compartments 30 results in a vessel that is more box-shaped and of larger volume. As used herein, generally box-shaped includes box-shaped (right cuboid) as well as other shapes that are close to box-shaped in contrast to the cylindrical-shape of vessels used in prior art containers for flowable materials.

The top wall 17 of the container 10 includes a circular hatch 32 for accessing the interior of the vessel 42 and for filling it with flowable material. Because the top wall 17 potentially can be inaccessible (for example when another container is stacked on top of this container 10), the container 10 also includes a fuel intake port 33 near the top of each of the side walls 15 and 16. (Only the fuel intake port 33 on the left side wall 15 is visible in FIG. 1.) The circular hatch 32 and/or the fuel intake ports 33 may include a vent valve (not shown) incorporated within as a pressure release safety mechanism. The top wall 17 also includes a solar panel 34, which may optionally be included as a means for generating electricity. The container 10 also includes a drainage port 35 near the bottom of each of the side walls 15 and 16 and a drainage port 46 in the bottom wall 18 (drainage port 46 shown in FIG. 5). The drainage ports 35 and 46 allow for passive emptying of the vessel 42 through gravity in the event that a pump is not available, does not work, or does not have power. The pump and the hose may be connected to drainage ports 35 or 46, or, optionally, the pump and the hose may be connected to ports specifically built for the pump and hose located within compartments 30. Optionally, other embodiments of the invention may have the fuel intake port 33 and the drainage port 35 on the front or rear end walls 13 or 14.

Figure 2:
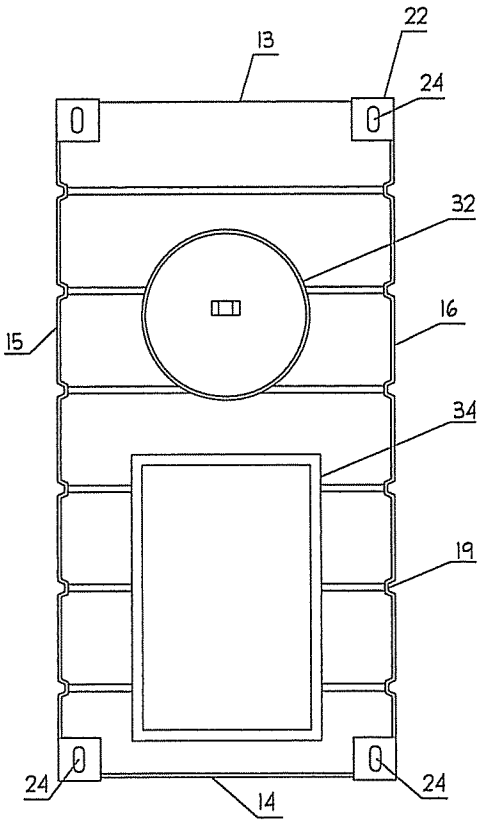
FIG. 2 illustrates a top plan view of a container according to an embodiment of the present invention.

FIG. 2 illustrates a top plan view of the container 10. As can be seen, each of the four upper corner fittings 22 has an eyelet 24 that faces upward. These upwardly-facing eyelets 24 can, through the use of a twist lock, be secured to complementary downwardly-facing eyelets 24 on lower corner fittings of another container that can be mounted on top of this container 10. Additionally, the upwardly-facing eyelets 24 can serve as an attachment point for a lifting or moving apparatus such as a crane.

Figure 3:
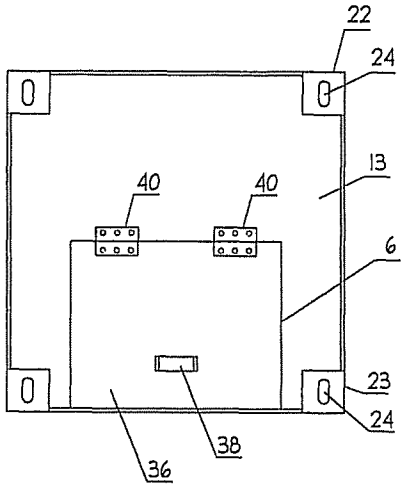
FIG. 3 illustrates an end elevation view of a container according to an embodiment of the present invention.

FIG. 3 illustrates a front end elevation view of the container 10. The container 10 includes two doors 36 for accessing the compartments 30. (Only one door 36—the one on the front end wall 13—is visible in FIG. 3.) Each door 36 includes a handle 38 for gripping and swings open via hinges 40. Optionally, in an alternative embodiment, a compartment door can open in a different manner, for example, by rolling or sliding up and down into and out of a slot above the compartment.

Each of the two upper corner fittings 22 and each of the two lower corner fittings 23 that are visible in FIG. 3 have an eyelet 24 that faces frontward for securing to corner fittings on other containers or to a transport apparatus or platform or for use with a lifting or moving apparatus.

Figure 4:
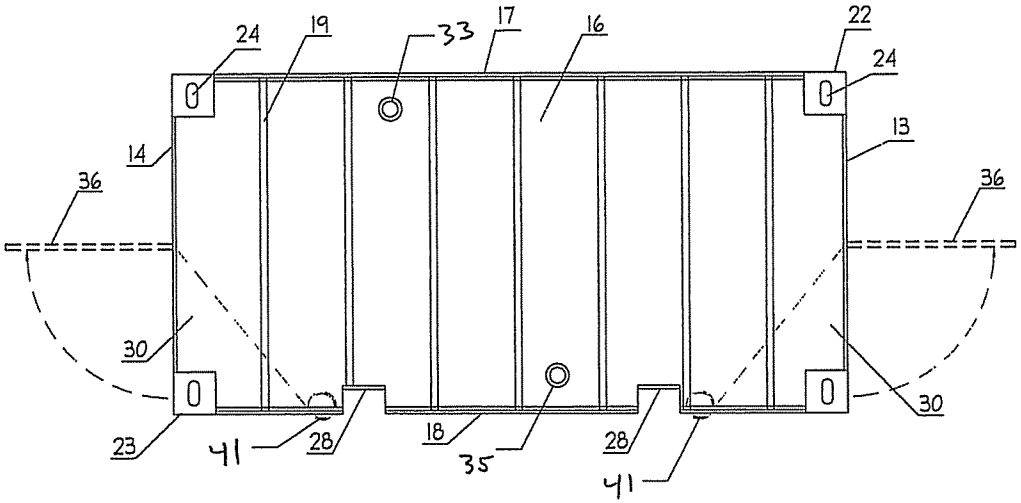
FIG. 4 illustrates a side elevation view of a container according to an embodiment of the present invention.

FIG. 4 illustrates a right side elevation view of the container 10. Each of the two upper corner fittings 22 and each of the two lower corner fittings 23 that are visible in FIG. 4 have an eyelet 24 that faces the right side for securing to corner fittings on other containers or to a transport apparatus or for use with a lifting or moving apparatus. Also, both compartments 30 and doors 36 for accessing them can be seen in FIG. 4, although shown in dashed lines.

The bottom wall 18 includes two rollers 41 (shown in dashed lines in FIG. 4) for rolling the container 10, for example, off the back of a truck or trailer or along another surface (e.g., pavement). The rollers 41 are recessed in FIG. 4 so that the weight of the container 10 does not rest on the rollers 41, but they may be extended by a small amount when needed. In other embodiments it may be advantageous to have rollers 41 in alternative locations or orientations to facilitate rolling a container in a different orientation off of the back of a truck or trailer, or to facilitate rolling a container in a different direction on the ground.

Figure 5:
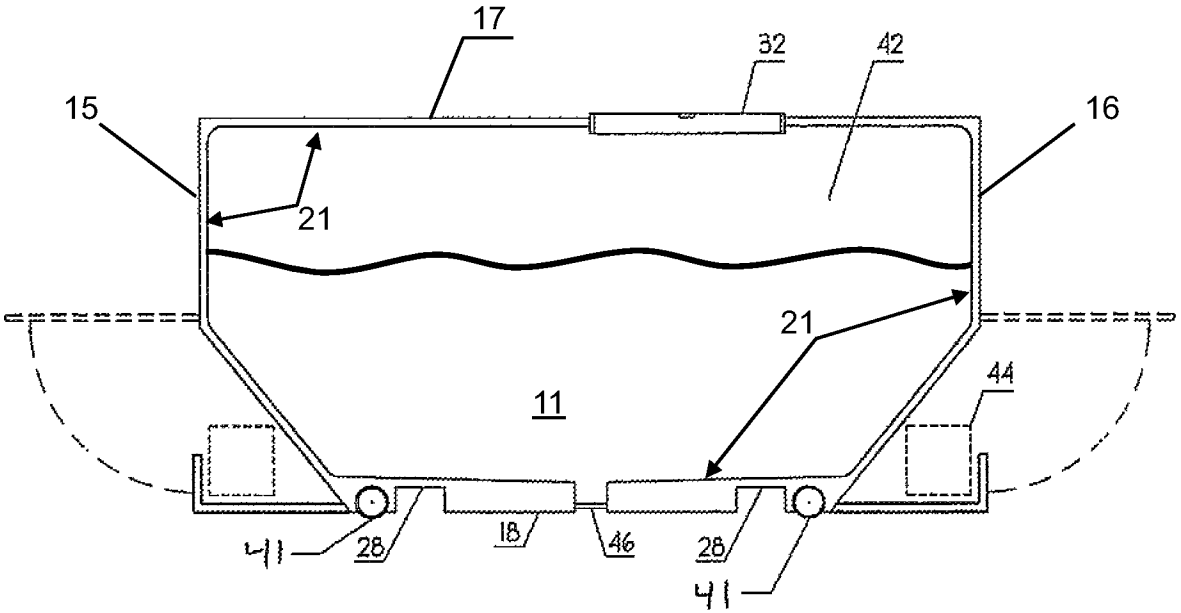
FIG. 5 illustrates a longitudinal sectional view of a portion of a container according to an embodiment of the present invention.

FIG. 5 illustrates a longitudinal sectional view of a portion of the container 10 (e.g., as taken from rear to front). The vessel 42 can be clearly seen in FIG. 5. The vessel 42 may include walls 13-18 (only top 17, bottom 18, and side 15-16 walls are illustrated in FIG. 5; see FIGS. 1 and 4, for example, for front and rear end walls 13 and 14) that are self-sealing (self-healing) with respect to small holes, including punctures and cracks, that are less than 0.5 inches across, according to known methods, including coating the exterior surface of the vessel 42 with a self-sealing agent. Such self-sealing technologies are described, for example, in U.S. Pat. No. 2,446,811 to Crawford, U.S. Pat. No. 4,345,698 to Villemain, and U.S. Pat. No. 7,169,452 to Monk et al. Additionally, the vessel 42 may include walls that are coated or layered with a fire suppressant material or a material that remains strong during a fire. Such fire and heat resistant technologies are described, for example, in U.S. Pat. No. 4,912,194 to Rosenquist and U.S. Pat. No. 5,378,539 to Chen, and in U.S. Patent Application Publication No. 2004-0071912 by Berth. Also, the vessel 42 may include walls 13-18 that are coated or layered on their interior surface to prevent or resist corrosion or degradation from flowable materials 11 such as fuel or chemicals. Additionally, the vessel 42 may include walls 13-18 having a permeation barrier 21 comprising a fluorine based compound, ethylene vinyl alcohol, or another material for inhibiting the permeation of a flowable material 11 into or through the vessel walls 13-18.

Also seen in FIG. 5 is a representative block of equipment 44 in each compartment 30 as well as the drainage port 46 in the bottom wall 18.

Optionally, the internal volume of the vessel 42 may be reduced while maintaining the overall volume of the container 10 to allow for additional features such as larger compartments 30 or thicker walls 13-18.

Figure 6:
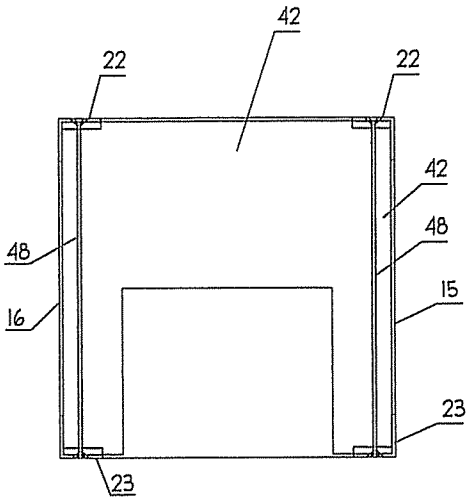
FIG. 6 illustrates a transverse sectional view of a portion of a container according to an embodiment of the present invention.

FIG. 6 illustrates a transverse sectional view of a portion of the container 10 taken from side to side through a section proximate the front end 13 of the container 10. As can be seen, each upper corner fitting 22 and each corresponding lower corner fitting 23 include a vertical-support rod 48 extending therebetween. The vertical-support rods 48 are made of steel, other metal alloy, or other strong material such that they bear a majority, if not all, of the weight of any containers that may be stacked on top of this container 10. Thus, the end and side walls 13-16 are substantially—perhaps entirely—relieved of the burden of supporting the weight of any containers that may be stacked on top of this container 10. The vertical-support rods 48 may extend, at least partially, through the interior of the vessel 42 of the container 10 as illustrated in FIG. 6. This allows the support rods to provide sufficient structural support while maximizing the vessel's volume. Although not illustrated in the figures, certain embodiments of the present invention may employ horizontal-support rods to provide additional structural support. Each horizontal-support rod extends between either two upper corner fittings or between two lower corner fittings. Like the vertical-support rods 48, the horizontal-support rods may extend, at least partially, through the interior of the vessel of the container.

Figure 7:
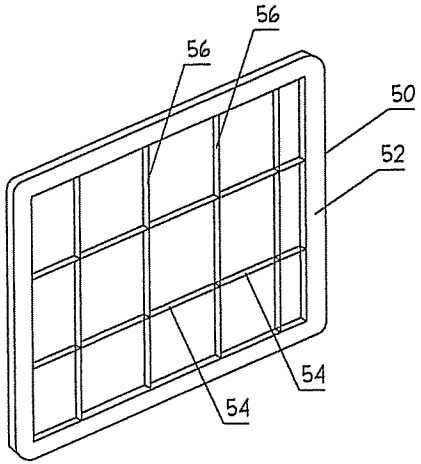
FIG. 7 illustrates an isometric view of a baffle for use with a container according to an embodiment of the present invention.
Figure 14:
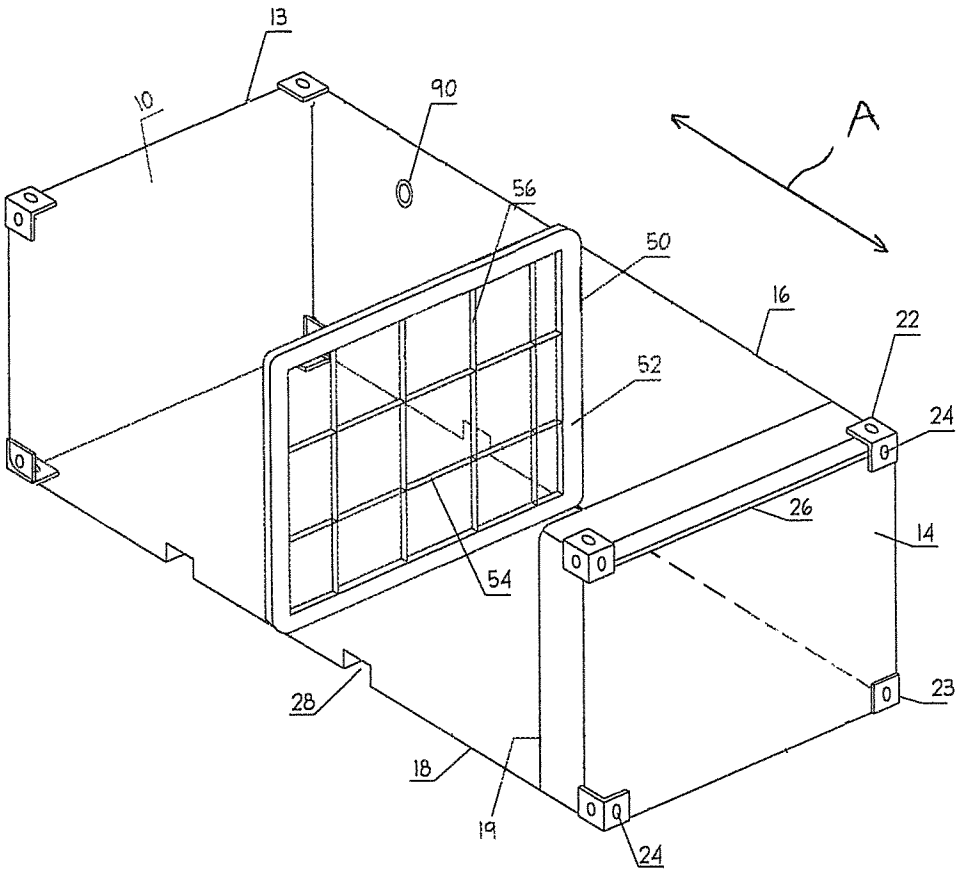
FIG. 14 illustrates a sectional view of a portion of a container according to an embodiment of the present invention.

FIG. 7 illustrates an isometric view of a baffle 50 that may be used inside the vessel 42 of the container 10 (as illustrated in FIG. 14) to reduce sloshing of the flowable material when being transported and to provide additional structural support for one or more of the walls 13-18 of the container 10. The baffle 50 includes a frame 52 that supports a lattice of intersecting horizontal linear members 54 and vertical linear members 56, which interact with flowable material moving inside the vessel 42 to reduce its sloshing. By reducing the sloshing of the flowable material, the baffle 50 reduces the pressure exerted on the walls 13-18 of the container 10. The baffle 50 may be composed of plastic or other lightweight material to minimize the tare weight of the container 10. Additionally, the baffle's horizontal and vertical linear members 54 and 56 may reinforce the walls 13-18 of the container 10 allowing the container walls 13-18 to be made thinner and lighter without deforming their shape. If the baffle 50 is used for reinforcing the walls 13-18, the baffle 50 may be composed of a material that is stronger and/or stronger per density than plastic.

Figure 8:
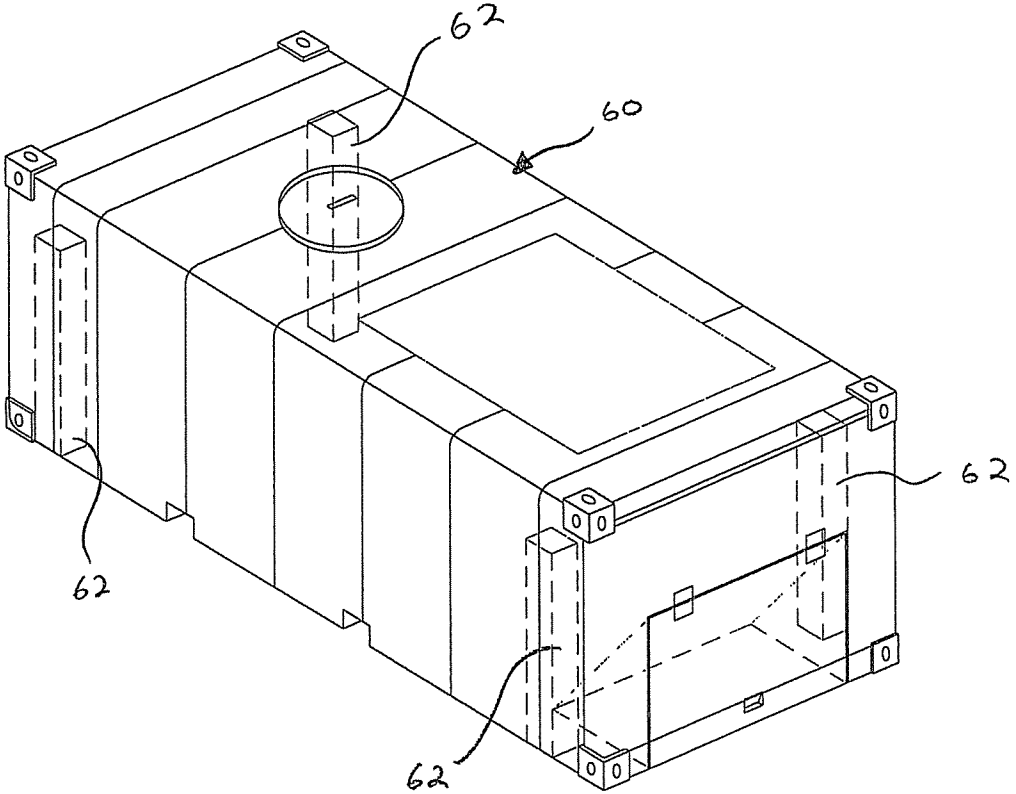
FIG. 8 illustrates an isometric view of a container with stored legs according to an embodiment of the present invention.
Figure 9:
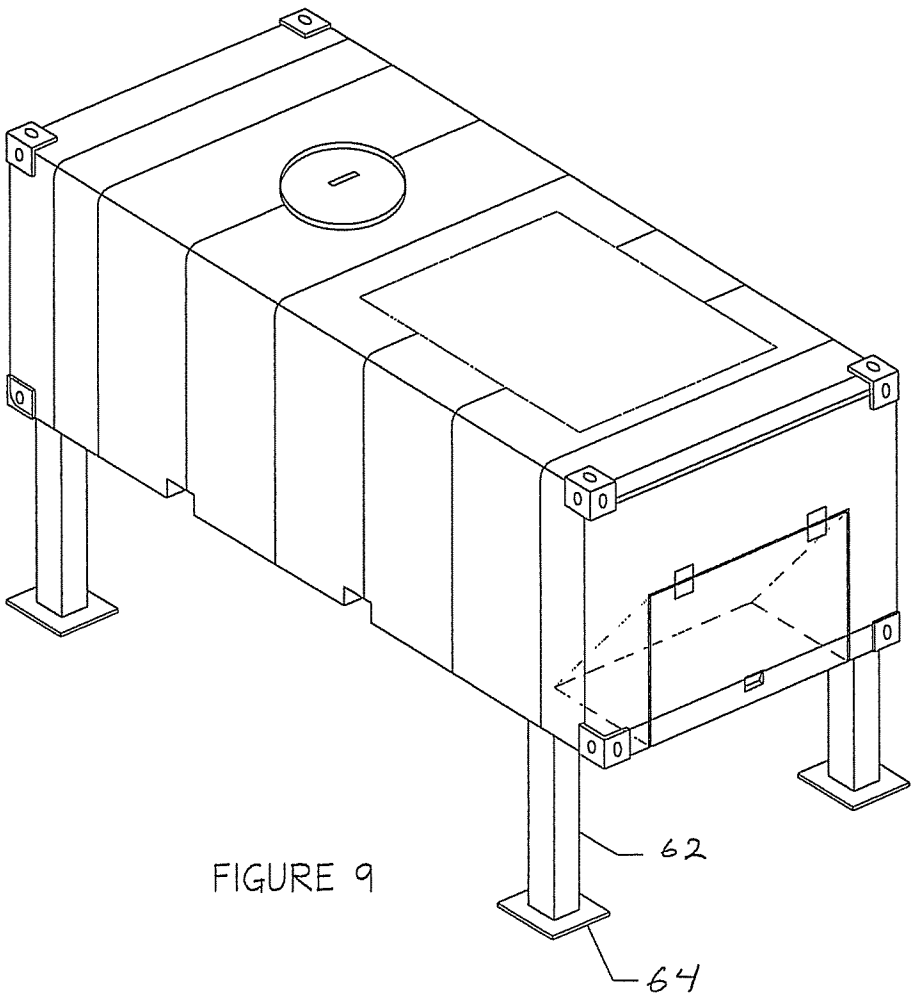
FIG. 9 illustrates an isometric view of a container with deployed legs according to an embodiment of the present invention.

FIGS. 8 and 9 illustrate a lightweight, intermodal and modular container 60 for shipping flowable materials that includes deployable legs 62 that can support the container 60 above the ground. The legs 62 allow for quick loading and unloading of the container 60 from a truck or other hauling vehicle without the use of a hoisting or lifting apparatus. FIG. 8 illustrates the legs 62 in their stored position, stored in rectangular channels extending vertically up through the container 60 from the bottom wall 18. FIG. 9 illustrates the legs 62 deployed and contacting the ground. Each leg 62 is extendable in a telescopic fashion, and may be so extendable through the use of a built-in jack (not shown) or hydraulics. Accordingly, when unloading the container 60, the legs 62 can be deployed outward and downward to contact the ground, the legs 62 can then be extended, for example via jacks, to lift the container 60 above the cargo platform of a truck (or other transport apparatus), and the truck can be driven out from underneath the container 60, the weight of which is now being supported by the legs 62. The legs 62 have feet 64 that flare out from the bottom of the legs 62 to enhance stability and minimize the possibility of the legs 62 sinking into the ground. Optionally, the legs 62 on either side of the container 60 are spaced wider from one another than the width of the cargo platform of a truck (or other transport apparatus).

When several containers 60 are secured together either horizontally or vertically using corner fittings, less than all of the legs 62 may need to be deployed to support all of the containers 60. For example, if several containers 60 are secured together only the four legs at the outer most corners of the group of containers 60 may need to be deployed and extended to the ground thereby saving time and effort in unloading and loading the group of containers 60 from a truck, trailer, rail car, or other transport vehicle. Alternatively, legs other than, or in addition to, the four outermost legs may be deployed and extended to the ground to support a group of containers that are secured to one another. If additional support is necessary, for example due to the weight and/or number of containers secured together, additional legs may be deployed and extended to the ground.

Figure 10:
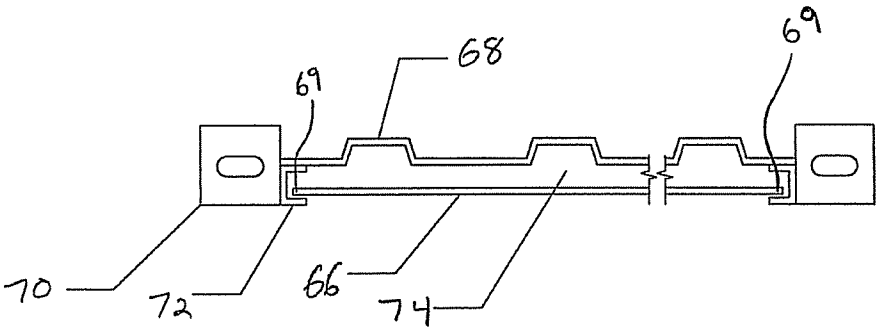
FIG. 10 illustrates a top plan view of a removable panel attached to a container wall according to an embodiment of the present invention.

FIG. 10 illustrates a top view of a removable panel 66 attached to a corrugated container wall 68. At each end of the container wall 68 is a corner fitting 70. Each corner fitting 70 includes a U-shaped bracket 72 that can receive an edge of the removable panel 66 therein. To attach the removable panel 66 to the container wall 68, the removable panel 66 may be passed downward from above as its vertical edges 69 slide through the U-shaped brackets 72. Other methods of securing removable panels to container walls are contemplated even if not explicitly described herein.

The removable panel 66 is removable so that a container to which it attaches may have a lower tare weight, and, therefore, may hold a greater payload (e.g., a greater amount of fuel) when being transported. The removable panel 66 may serve various purposes when attached to a container. For example, it may be a solar panel that provides electricity. It can be a protective panel that provides protection to a container from artillery fire, small arms fire, mortar fire, shrapnel and the like. It can be an insulating panel that provides thermal insulation to a container's contents (e.g., water, food, etc.) if desired.

When the removable panel 66 is attached to the wall 68 as shown in FIG. 10, a space 74 can be formed between the panel 66 and the wall 68. The space 74 can be filled with a readily available material such as earth, sand, dirt and gravel to provide (additional) protection to a container, in a military setting, for example, from artillery fire, small arms fire, mortar fire, shrapnel and the like.

The removable panel 66 may be transported with a container or may be provided at a transport destination.

Figure 11:
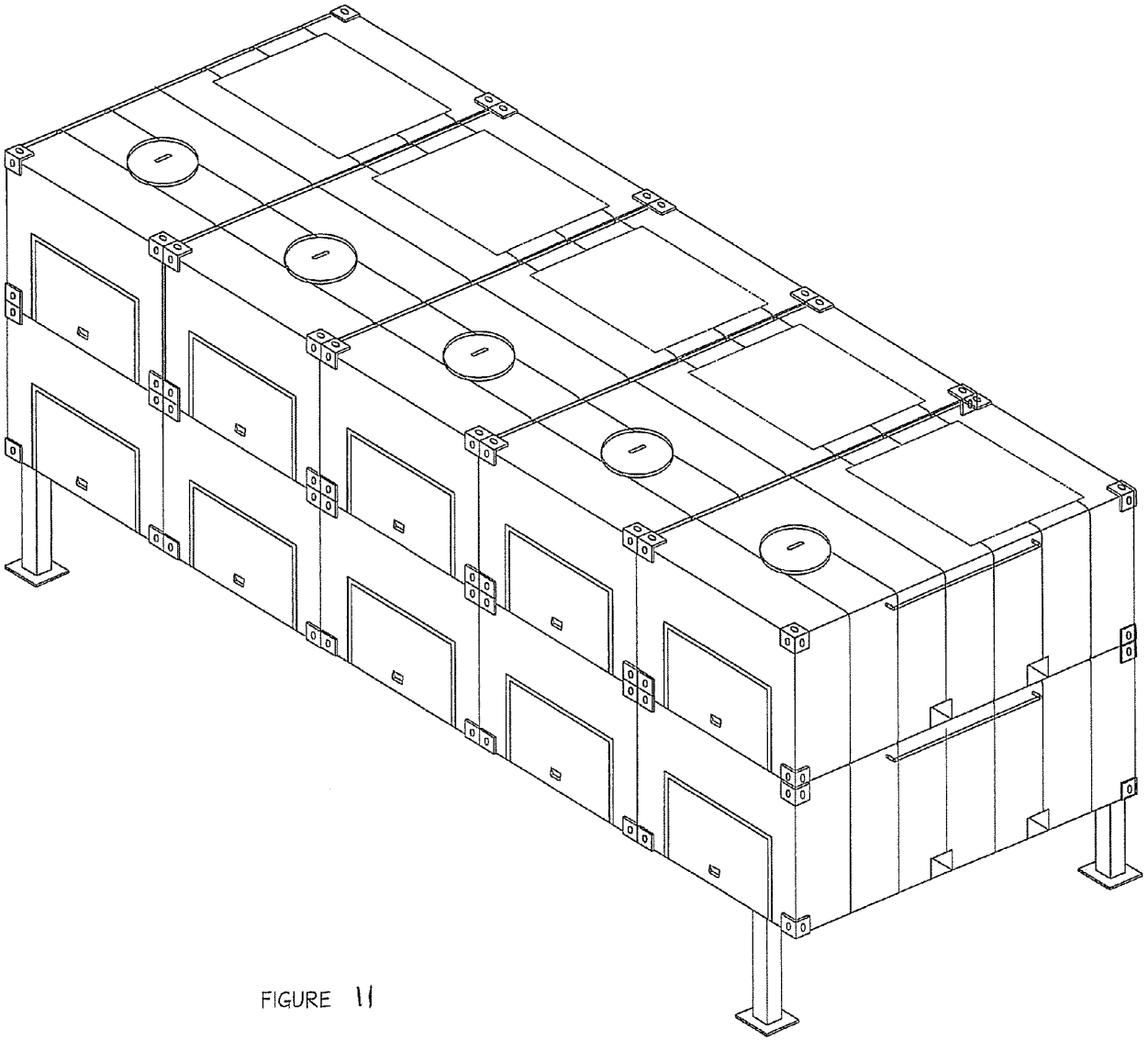
FIG. 11 illustrates an isometric view of a plurality of containers supported by legs according to an embodiment of the present invention.

FIG. 11 illustrates an isometric view of ten containers secured to one another and supported by four legs. The containers are all arranged in the same orientation, though they need not be (see FIG. 12). The ten containers, which each may be constructed of varying material, are secured to one another via their corner fittings and twist locks (twist locks not visible). The ten containers can be lifted, loaded, unloaded, moved, etc. as a single unit. In FIG. 11, the ten containers are supported by just four legs, extending from multiple containers. The containers may be unsecured from one another for logistics or other purposes as desired.

Figure 12:
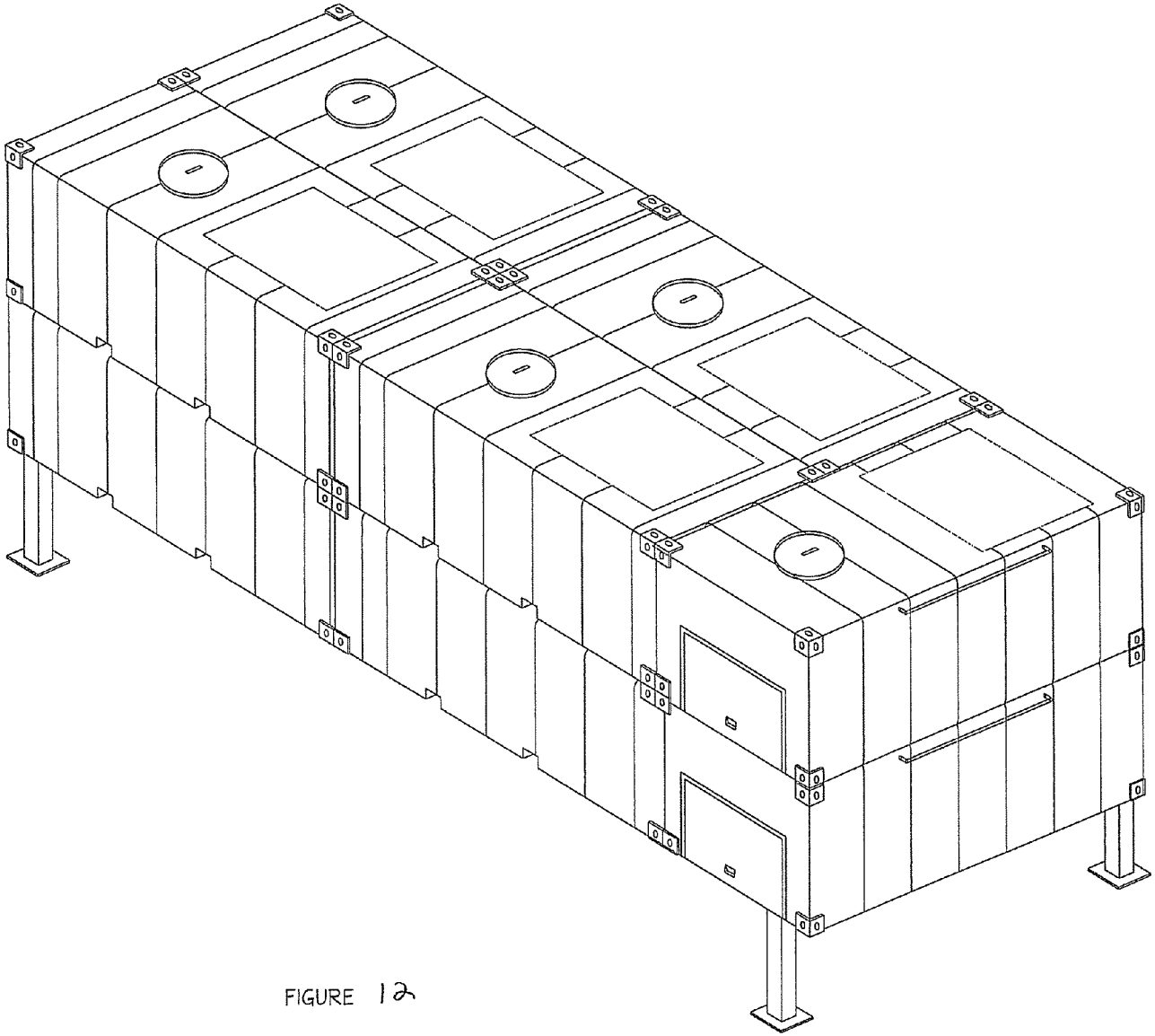
FIG. 12 illustrates an isometric view of a plurality of containers supported by legs according to an embodiment of the present invention.

FIG. 12 illustrates an isometric view of ten containers secured together and supported by four legs. The containers are secured together in varying orientations. It should be noted that containers of varying sizes (in addition to varying orientations) can be secured to one another. It should also be noted that one or more containers for shipping and storing flowable materials can be secured to one or more containers for non-flowable materials such as dry goods, electrical power generation, banks of batteries, or other supplies and equipment.

Figure 13:
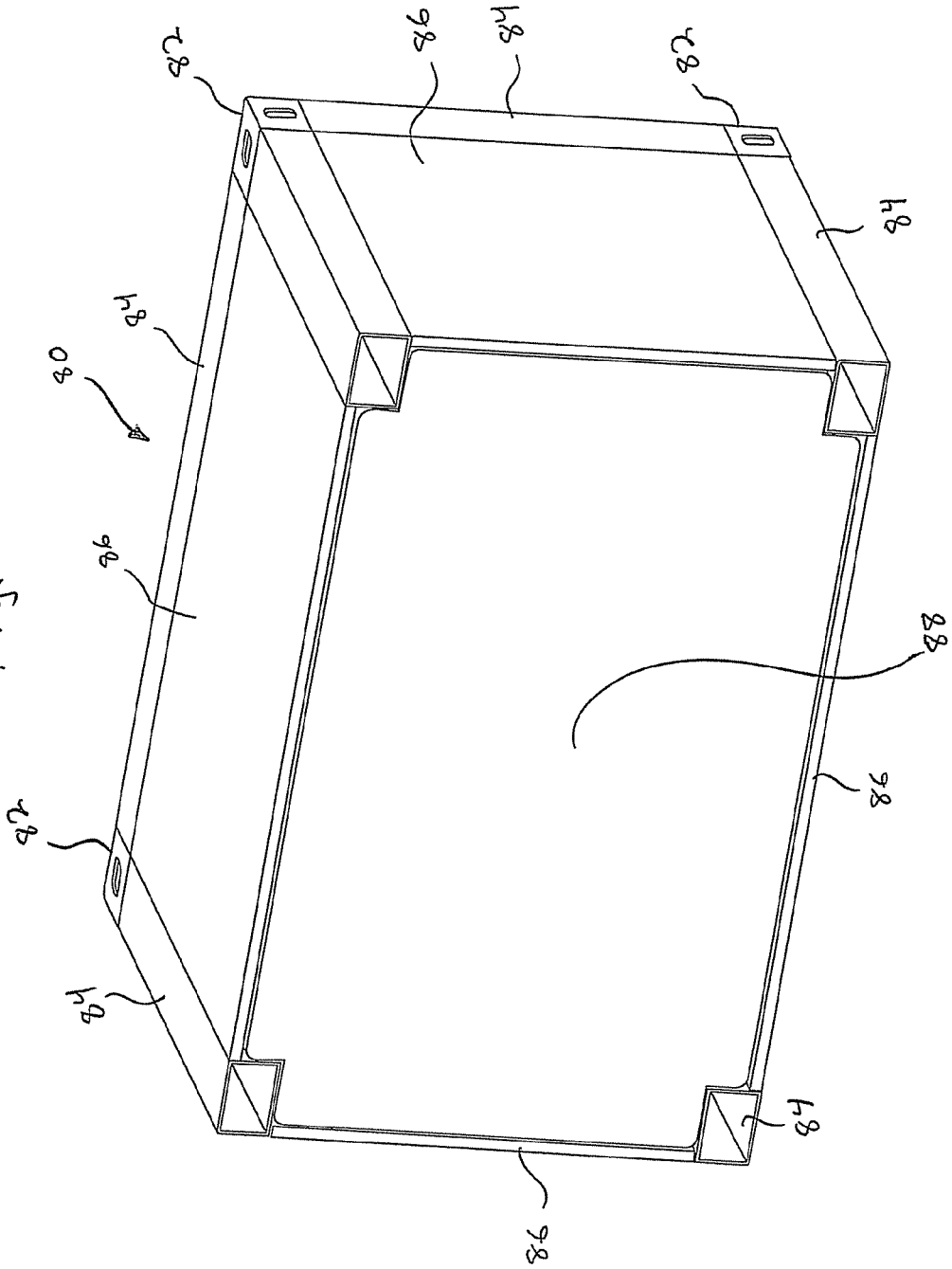
FIG. 13 illustrates a sectional view of a portion of a container according to an embodiment of the present invention.

FIG. 13 illustrates an isometric view of a portion of a container 80 with a cross section of the interior of the container 80 being visible. Aluminum corner fittings 82 are supported by aluminum connecting members 84. Each connecting member 84 extends either horizontally between two upper corner fittings, horizontally between two lower corner fittings, or vertically between one upper corner fitting and one lower corner fitting. The corner fittings and/or connecting members alternatively may be comprised of another material, including another relatively lightweight material having similar strength properties to aluminum. The container walls 86 are made of a composite or plastic material and surround a vessel 88. The vessel 88 is shaped to utilize the maximum allowable interior space of the container 80. Thus, the vessel 88 is not cylindrically-shaped and does not have a cross section that is circular such as in prior art containers for flowable materials. Instead, the vessel 88 is generally box-shaped with a generally rectangular cross-section. The vessel 88 may not be perfectly box-shaped and may not have a perfectly rectangular cross-section due to the space occupied by other components such as the connecting members 84 and corner fittings 82. Although the connecting members 84 are illustrated as being rectangular tubes or beams, they could comprise other structures that connect corner fittings to one another to provide structural support such as rods.

Various embodiments of the present invention may employ containers of varying sizes. For example, a container of any of the ISO standard sizes (e.g., 20, 40, 45, 48, and 53 foot long ISO containers) may be employed for larger uses, while a container representing a fractional unit of a 20 foot ISO container may be employed for smaller uses. A container representing a fractional unit of a 20 foot ISO container includes what are known as BiCons, TriCons, QuadCons, or SixCons in the U.S. military. A BiCon measures approximately 96"×120"×96" and two BiCons can be arranged together to roughly equal the dimensions of one 20 foot ISO container. A Tricon measures approximately 96"×78"×96," and three TriCons can be arranged together to roughly equal the dimensions of one 20 foot ISO container. A QuadCon measures approximately 96"×57"×96", and four QuadCons can be arranged together to roughly equal the dimensions of one 20 foot ISO container. A SixCon measures approximately 96"×80"×48", and six SixCons can be arranged together to roughly equal the dimensions of one 20 foot ISO container. Additionally, containers may be sized to match rail cars, pick-up trucks, High Mobility Multipurpose Wheeled Vehicles (HUMVEE), Joint Light Tactical Vehicles, trailers, air cargo holds or fractional sizes of any of these and other transport apparatus. Certain embodiments of the present invention may employ any of these sized containers or others.

Certain embodiments of the present invention may employ a container that conforms to ISO standard 668:1995 regarding freight container classifications, dimension, and ratings for use with ships, trucks, trailers, aircraft, rail cars, etc. or a container that conforms to ISO standard 1496:1995 regarding tank containers for liquids, gases and pressurized dry bulk.

Certain embodiments of the present invention may employ a container equipped with sensors 90 (as illustrated in FIG. 14) and appropriate electronic equipment to facilitate container informatics and optimize logistics. Sensors 90 may report container status such as container location, temperature, humidity, vapor pressure, weight, fluid level, filter status, contamination, container orientation, tampering, and history of the container. The electronics integrated into the container may enable operators to read sensor values, communication between multiple linked containers, or uploading of data to a centralized data warehouse. The electronics integrated into the container may also include wireless communication apparatus for communicating data obtained from the sensors 90 to a remote location.

While certain embodiments of the present invention employ containers with vessels composed of fiberglass, other embodiments may include containers with vessels composed of other strong and lightweight materials such as polyethylene, including high density polyethylene, carbon fiber composites, basalt fiber composites, aluminum, titanium, magnesium, high strength steel, other metals, nylon 6, balsa wood, resin, and epoxy composites.

Certain embodiments of the present invention may employ containers with vessels composed of a material having a certain maximum density. For example, the vessel may be composed of a material having a maximum density of 3 $g/cm^3$, 2 $g/cm^3$, or 1 $g/cm^3$. Also, certain embodiments of the present invention may employ a container having a vessel composed of a material that is less dense than the material used in corner fittings and/or connecting members. For example, the vessel may be composed of a material having a density that is less than one fourth, one third, or one half the density of the material of which the corner fittings and/or connecting members are composed.

Certain embodiments of the present invention may employ a container having a vessel composed of a material that has a lower ultimate tensile strength (tensile strength) than the material used in corner fittings and/or connecting members. For example, the vessel may be composed of a material having a tensile strength that is less than one twentieth, one tenth, or one fifth the tensile strength of the material of which the corner fittings and/or connecting members are composed.

Certain embodiments of the present invention may employ containers with vessels composed of a material having a certain minimum tensile strength to density ratio. For example, the vessel may be composed of a material having a minimum strength to density ratio of 80 $MPa/(g/cm^3)$, 200 $MPa/(g/cm^3)$, 500 $MPa/(g/cm^3)$, or 1000 $MPa/(g/cm^3)$. Also, certain embodiments of the present invention may employ a container having a vessel composed of a material that is stronger per density than the material used in corner fittings and/or connecting members. For example, the vessel may be composed of a material having a tensile strength to density ratio that is 2 times, 4 times, or 10 times the strength to density ratio of the material of which the corner fittings and/or connecting members are composed. Alternatively, certain embodiments of the present invention may employ a container having a vessel composed of a material that is weaker per density than the material used in corner fittings and/or connecting members.

Since certain embodiments of the present invention employ vessels for flowable materials having transverse cross-sections that are rectangular (and not circular or oval), some embodiments of containers for flowable materials may be easily made to be indistinguishable to an enemy force from containers for dry goods.

While certain embodiments of the present invention employ vertical-support rods between corresponding upper and lower corner fittings, other embodiments may include horizontal-support rods extending between two or more lower corner fittings and/or or between two or more upper corner fittings. Like the vertical-support rods, the horizontal-support rods may extend through the interior space of the vessel.

While certain embodiments of the present invention employ containers with vessels whose walls are reinforced by corrugation folds, other embodiments may include vessels whose walls are reinforced by components that are exterior to the vessel walls and composed of a stronger material than that of the vessel itself. For example, a vessel that is composed of a material having a relatively lower tensile strength such as polyethylene may be reinforced by a stronger material such as steel that forms a support structure (e.g., in a latticed configuration) on the exterior of the vessel walls. The support structure may consist of intersecting linear members that form a lattice that covers only a minority of the external area of the vessel, thus minimizing tare weight of the container while maximizing reinforcement of the vessel walls. The support structure helps prevent the vessel walls from rupturing or expanding outwards due to forces generated by the weight of flowable material inside the vessel and exerted on the vessel walls.

Further, certain embodiments of the present invention may not have rods or beams connecting two or more corner fittings, but may have extensions that extend from the corner fittings. Each corner fitting extension extends from only one corner fitting and does not extend all the way to a second corner fitting. Each corner fitting may have multiple extensions. Such corner fitting extensions may enhance the strength of bonding between the corner fittings and the container (or vessel) by extending into the walls of the container (or vessel) and by providing additional contact area between the corner fittings and the container (or vessel).

While certain embodiments of the present invention employ top, side, and bottom walls that are generally planar with any deviations from planar being due to rounded edges and corrugation folds, it should be noted that other embodiments may employ top, side, and bottom walls that are perfectly planar or deviate from being planar due to features other than rounded edges or corrugation folds. Similarly, while certain embodiments of the present invention employ end walls that are perfectly planar, other embodiments may employ end walls that are only generally planar.

While certain embodiments of the present invention have been described with respect to their utilization with various transportation modalities, it will be understood by those skilled in the art that utilization of the present invention by all forms of equipment, platforms, and vehicles for transport or other movement are contemplated.

Certain embodiments of the present invention may employ containers with vessels of varying volumes, including vessels exceeding 100 U.S. gallons, vessels containing 700 to 5000 U.S. gallons, vessels containing 900 to 1400 gallons, and vessels containing other volumes.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiments disclosed, but that the invention will include all embodiments falling within the scope of the appended claims.

The invention claimed is:

1. A container for shipping and storing flowable materials comprising:

a vessel holding liquid, semi-solid, or solid flowable material, said vessel formed of six generally planar walls comprising a permeation barrier, said vessel having a generally rectangular cross-section as taken along at least one path from side to side, said six generally planar walls comprising:

two side walls, two end walls, a bottom wall, and a top wall comprising a hatch configured to provide access to an interior of said vessel and to input said flowable material into said vessel; and a plurality of corner fittings securely attached to said vessel, wherein one or more of said corner fittings enables said container to be lifted, and wherein one or more of said corner fittings enables said container to be secured to one of a transport platform, transport vehicle, and another container; wherein said six generally planar walls have a density less than 3 grams per cubic centimeter; wherein said six generally planar walls have a tensile strength to density ratio of at least 80 megapascals per gram per cubic centimeter; and further comprising a plurality of connecting members to provide a frame structure to support said corner fittings, each of said connecting members extending from one of said corner fittings to another of said corner fittings.

2. The container of claim 1 wherein at least one of:

at least one of said two side walls, and at least one of said two end walls, comprises an intake port configured to provide access to input flowable material into said vessel.

3. The container of claim 1 wherein said connecting members and said corner fittings are substantially composed of metal.

4. The container of claim 1 wherein at least one of said connecting members and said corner fittings is substantially composed of a material that has a tensile strength that is at least five times as strong as a tensile strength of said six generally planar walls.

5. The container of claim 1 wherein at least one:

at least one of said two side walls, at least one of said two end walls, and said bottom wall, comprises a drainage port configured to provide access to drain flowable material from said vessel.

6. The container of claim 1 wherein one of said corner fittings includes an extension that extends along a surface of said vessel, said extension securely attached to said vessel.

7. The container of claim 1 wherein said vessel has a volume greater than 699 gallons and less than 5001 gallons.

8. The container of claim 1 further comprising a liquid, semi-solid, or solid flowable material baffle inside of said vessel, said baffle comprising a frame configured to support a lattice of intersecting horizontal linear members and vertical linear members.

9. The container of claim 1 further comprising a plurality of deployable legs that can be stored when said container is transported and deployed to contact the ground when said container is stationary.

10. A plurality of containers stacked on top of one another wherein each of said containers is the container of claim 1.

11. The container of claim 1 further comprising a sensor configured to sense data regarding one of the group consisting of temperature inside said vessel, humidity inside said vessel, vapor pressure inside said vessel, weight of flowable material inside said vessel, contamination inside said vessel, container orientation, container location, and tampering of said container.

12. The container of claim 1 wherein said container meets ISO standard 668:1995.

13. The container of claim 1 wherein one of said corner fittings meets ISO standard 1161:1984.

14. The container of claim 1 wherein each of said connecting members is a rod substantially composed of a metal alloy and extending through a portion of said vessel.

15. The container of claim 1 further comprising a removable panel attached to an exterior of said vessel, said panel being removable from said exterior to reduce the weight of said container.

16. A container for shipping and storing flowable materials comprising:

a vessel holding liquid, semi-solid, or solid flowable material, said vessel formed of six generally planar walls comprising a permeation barrier, said vessel having a generally rectangular cross-section as taken along at least one path from side to side, said vessel substantially composed of a rigid material having a density less than 3 grams per cubic centimeter and a tensile strength to density ratio of at least 80 megapascals per gram per cubic centimeter, said vessel having a vessel volume greater than 100 U.S. gallons;

a plurality of corner fittings securely attached to said vessel, wherein one or more of said corner fittings enables said container to be lifted, and wherein one or more of said corner fittings enables said container to be secured to one of a transport platform, transport vehicle, and another container; and a liquid, semi-solid, or solid flowable material baffle inside of said vessel, said baffle comprising a frame configured to support a lattice of intersecting horizontal linear members and vertical linear members;

wherein said container supports, without damage or deformity, the weight of another container containing water in an amount that exceeds half of said vessel volume.

17. A container for shipping and storing flowable materials comprising:

a generally box-shaped vessel holding liquid, semi-solid, or solid flowable material, said vessel inhibiting permeation of said flowable material, said vessel substantially composed of a first material; and eight corner fittings substantially composed of a second material, each of said corner fittings positioned at each of eight corners of said vessel, said corner fittings being securely attached to said vessel, said container simultaneously and directly secures to six other containers;

wherein said vessel is substantially composed of a rigid material having a density less than 3 grams per cubic centimeter and a tensile strength to density ratio of at least 80 megapascals per gram per cubic centimeter;

wherein said second material has one of the following qualities in comparison to said first material, said qualities consisting of (1) being at least four times as dense as said first material; (2) having a tensile strength that is least five times as strong as said first material; and (3) having a tensile strength to density ratio that is at least two times a tensile strength to density ratio of said first material.

* * * * *